US007701402B2

(12) United States Patent
Tsai et al.

(10) Patent No.: US 7,701,402 B2
(45) Date of Patent: Apr. 20, 2010

(54) ANTENNA HAVING WIDE IMPEDANCE BANDWIDTHS BOTH AT LOW AND HIGH FREQUENCIES

(75) Inventors: Tiao-Hsing Tsai, Yungho (TW); Chieh-Ping Chiu, Yunlin Shien (TW); Chih-Wei Liao, Yilan Shien (TW)

(73) Assignee: Quanta Computer Inc. (TW)

( * ) Notice: Subject to any disclaimer, the term of this patent is extended or adjusted under 35 U.S.C. 154(b) by 82 days.

(21) Appl. No.: 12/188,321

(22) Filed: Aug. 8, 2008

(65) Prior Publication Data

US 2009/0179808 A1 Jul. 16, 2009

(30) Foreign Application Priority Data

Jan. 16, 2008 (TW) ..... 97101651 A

(51) Int. Cl.
*H01Q 1/24* (2006.01)

(52) U.S. Cl. ..... 343/702; 343/700 MS; 343/767

(58) Field of Classification Search ..... 343/700 MS, 343/702, 767
See application file for complete search history.

(56) References Cited

U.S. PATENT DOCUMENTS 6,650,298 B2 * 11/2003 Abbasi et al. ..... 343/702
7,224,312 B2 * 5/2007 Wen et al. ..... 343/700 MS
7,626,551 B2 * 12/2009 Chien et al. ..... 343/700 MS

* cited by examiner

*Primary Examiner*—Tan Ho
(74) *Attorney, Agent, or Firm*—Sunstein Kahn Murphy & Timbers LLP

(57) ABSTRACT

An antenna includes a base element, grounding and feeding points, and first and second radiating elements. Each of the grounding and feeding points is provided on the base element. The first radiating element is operable in a first frequency band, and extends from the base element. The second radiating element is operable in a second frequency band lower than the first frequency band, extends from the base element, and is formed with a slot.

10 Claims, 6 Drawing Sheets

ANTENNA HAVING WIDE IMPEDANCE BANDWIDTHS BOTH AT LOW AND HIGH FREQUENCIES

CROSS-REFERENCE TO RELATED APPLICATION

This application claims priority of Taiwanese application no. 097101651, filed on Jan. 16, 2008.

BACKGROUND OF THE INVENTION

1. Field of the Invention

This invention relates to an antenna, more particularly to an antenna applicable to global system for mobile communications (GSM) devices.

2. Description of the Related Art

FIG. 1 illustrates a conventional antenna 11 installed in a mobile phone 10. The conventional antenna 11 is generally C-shaped, is provided with feeding and grounding points 12, 13, and includes feeding and grounding elements 15, 14, each of which is connected to a respective one of the feeding and grounding points 12, 13, and each of which is connected to a circuit board (not shown) of the mobile phone 10.

The conventional antenna 11 is disadvantageous in that, although the conventional antenna 11 achieves a relatively wide impedance bandwidth in a high frequency band, i.e., the conventional antenna 11 is operable in a frequency band from 1710 MHz to 1990 MHz, the conventional antenna 11 has a relatively narrow impedance bandwidth in a low frequency band, i.e., the conventional antenna 11 is operable only either in the GSM 850 frequency band from 824 MHz to 894 MHz or the GSM 900 frequency band from 880 MHz to 960 MHz.

SUMMARY OF THE INVENTION

Therefore, the object of the present invention is to provide an antenna that can overcome the aforesaid drawback of the prior art.

According to the present invention, an antenna comprises a base element, grounding and feeding points, and first and second radiating elements. The base element has opposite first and second end portions. Each of the grounding and feeding points is provided on a respective one of the first and second end portions of the base element. The first radiating element is operable in a first frequency band, and extends from the first end portion of the base element. The second radiating element is operable in a second frequency band lower than the first frequency band, extends from the first end portion of the base element, and is formed with a slot. The slot has a predetermined size that corresponds to the second frequency band.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
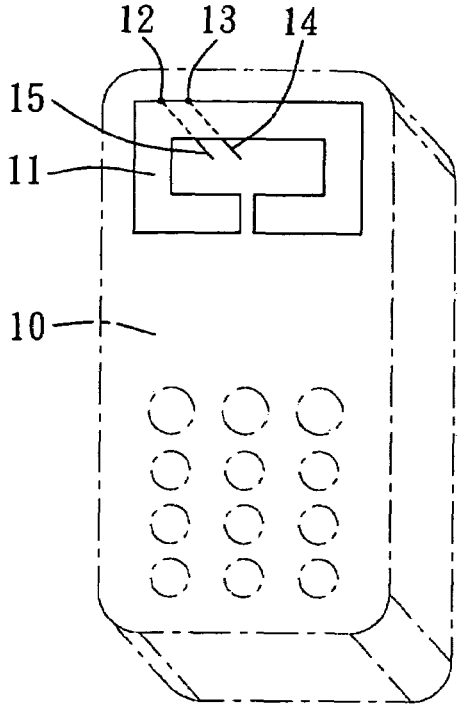
FIG. 1 PRIOR ART
FIG. 1 is a perspective view of a conventional antenna installed in a mobile phone.
Figure 2:
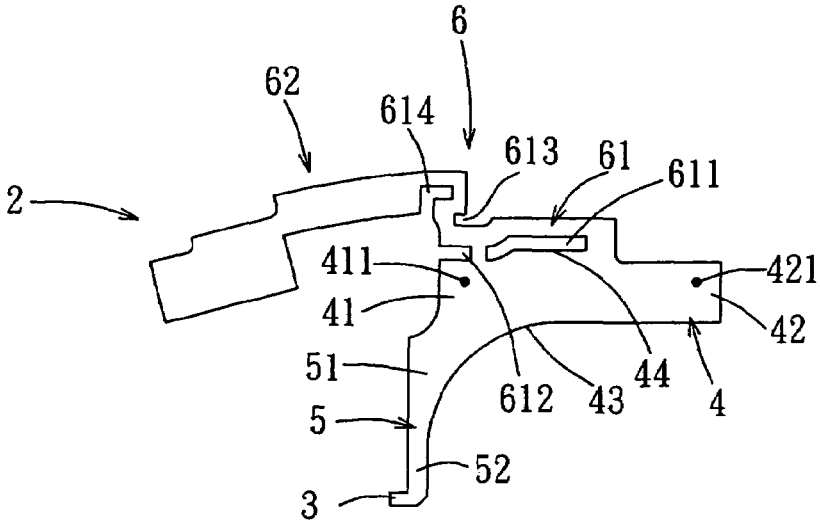
FIG. 2 is a schematic view of the preferred embodiment of an antenna according to this invention.
Figure 3:
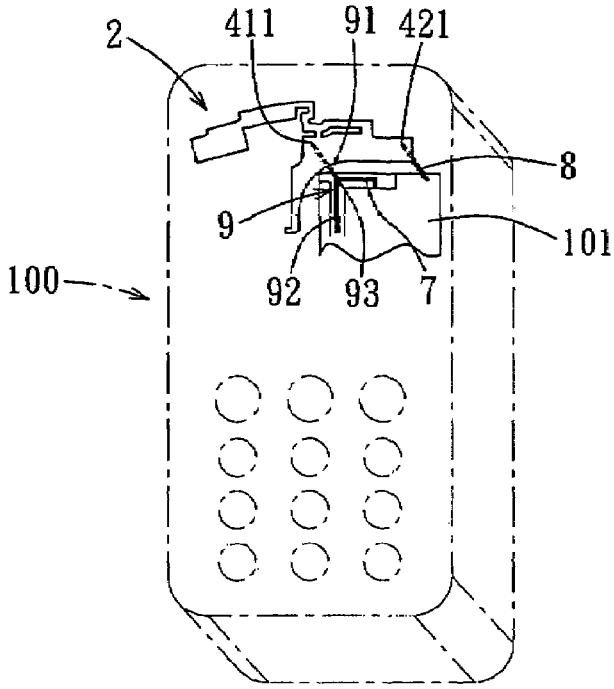
FIG. 3 is a perspective view illustrating an exemplary application in which the preferred embodiment is installed in a mobile phone.

Referring to FIGS. 2 and 3, the preferred embodiment of an antenna 2 according to this invention is shown to include a base element 4, feeding and grounding points 411, 421, and first and second radiating elements 5, 6.

The antenna 2 of this invention is a dual-band antenna, is installed in an electronic device 100, such as a personal digital assistant (PDA) or a mobile phone, and is operable in a first frequency band from 1710 MHz and 1990 MHz, and a second frequency band from 824 MHz and 960 MHz.

The base element 4 is generally rectangular in shape, and has first and second end portions 41, 42 that are opposite to each other in a first direction, and first and second sides 43, 44 that are opposite to each other in a second direction transverse to the first direction.

Each of the feeding and grounding points 411, 421 is provided on a respective one of the first and second end portions 41, 42 of the base element 4.

It is noted that the feeding and grounding points 411, 421 define a distance therebetween that affects an impedance bandwidth of the first frequency band.

In this embodiment, each of the first and second radiating elements 5, 6 is disposed at a respective one of the first and second sides 43, 44 of the base element 4.

The first radiating element 5 is operable in the first frequency band, i.e., from 1710 MHz to 1990 MHz, and has a first end portion 51 that extends from the first end portion 41 of the base element 4, and a second end portion 52 that is opposite to the first end portion 51 thereof in the second direction. In this embodiment, the first radiating element 5 is tapered toward the second end portion 52 thereof.

The antenna 2 further includes a protrusion 3 that protrudes from the second end portion 52 of the first radiating element 5. In this embodiment, the protrusion 3 is an elongated protrusion and extends in the first direction. That is, the protrusion 3 extends parallel to the base element 4 and transverse to the first radiating element 5.

The second radiating element 6 is operable in the second frequency band, i.e., from 824 MHz to 960 MHz, and has first and second end portions 61, 62 that are opposite to each other in the first direction. The first end portion 61 of the second radiating element 6 extends from the first end portion 41 of the base element 4, and is formed with first, second, and third slots 611, 612, 613. The second end portion 62 of the second radiating element 6 extends inclinedly from the first end portion 61 of the second radiating element 6 toward the first radiating element 5 and is formed with a fourth slot 614. In this embodiment, each of the first, second, third, and fourth slots 611, 612, 613, 614 has a predetermined size that corresponds to the second frequency band. That is, the size of each of the first, second, third, and fourth slots 611, 612, 613, 614 may be adjusted so as to increase or decrease an electrical length of the second radiating element 6 such that the second radiating element 6 resonates at a resonance frequency in the second frequency band. Moreover, in this embodiment, each of the first, second, and third slots 611, 612, 613 in the first end portion 61 of the second radiating element 6 is an elongated slot and extends in the first direction.

The antenna 2 further includes first and second grounding elements 8, 7, and a feeding element 9. The first grounding element 8 has a first end connected to the grounding point 421, and a second end connected to a circuit board 101 of the electronic device 100. The feeding element 9 has a first end portion 91 connected to the feeding point 411 and the circuit board 101 of the electronic device 100, and a second end portion 92 formed on the circuit board 101 of the electronic device 100. The second grounding element 7 is formed on the circuit board 101 of the electronic device 10 and is connected to a junction 93 of the first and second end portions 91, 92 of the feeding element 9. In this embodiment, the first and second end portions 91, 92 of the feeding element 9 and the second grounding element 7 are perpendicular to each other.

Figure 4:
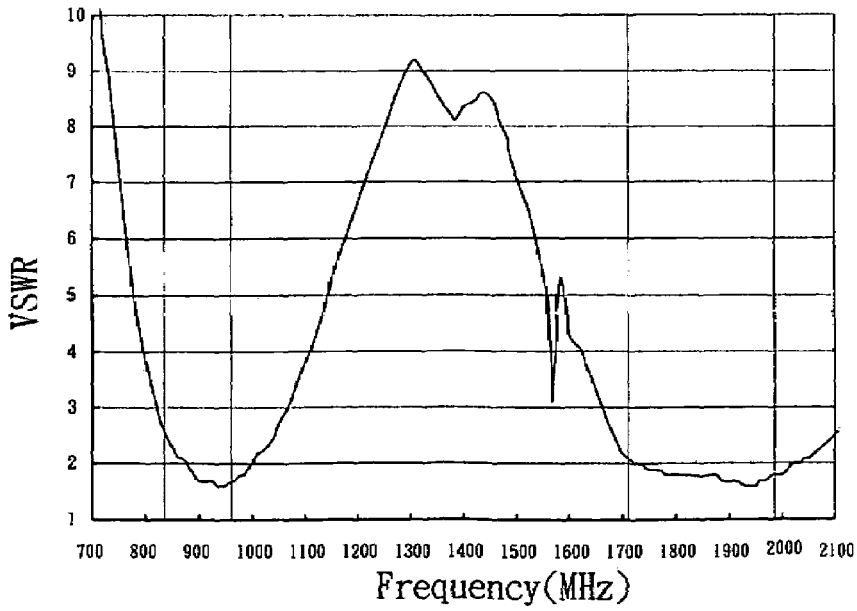
FIG. 4 is a plot illustrating a voltage standing wave ratio (VSWR) of the preferred embodiment.
Figure 5:
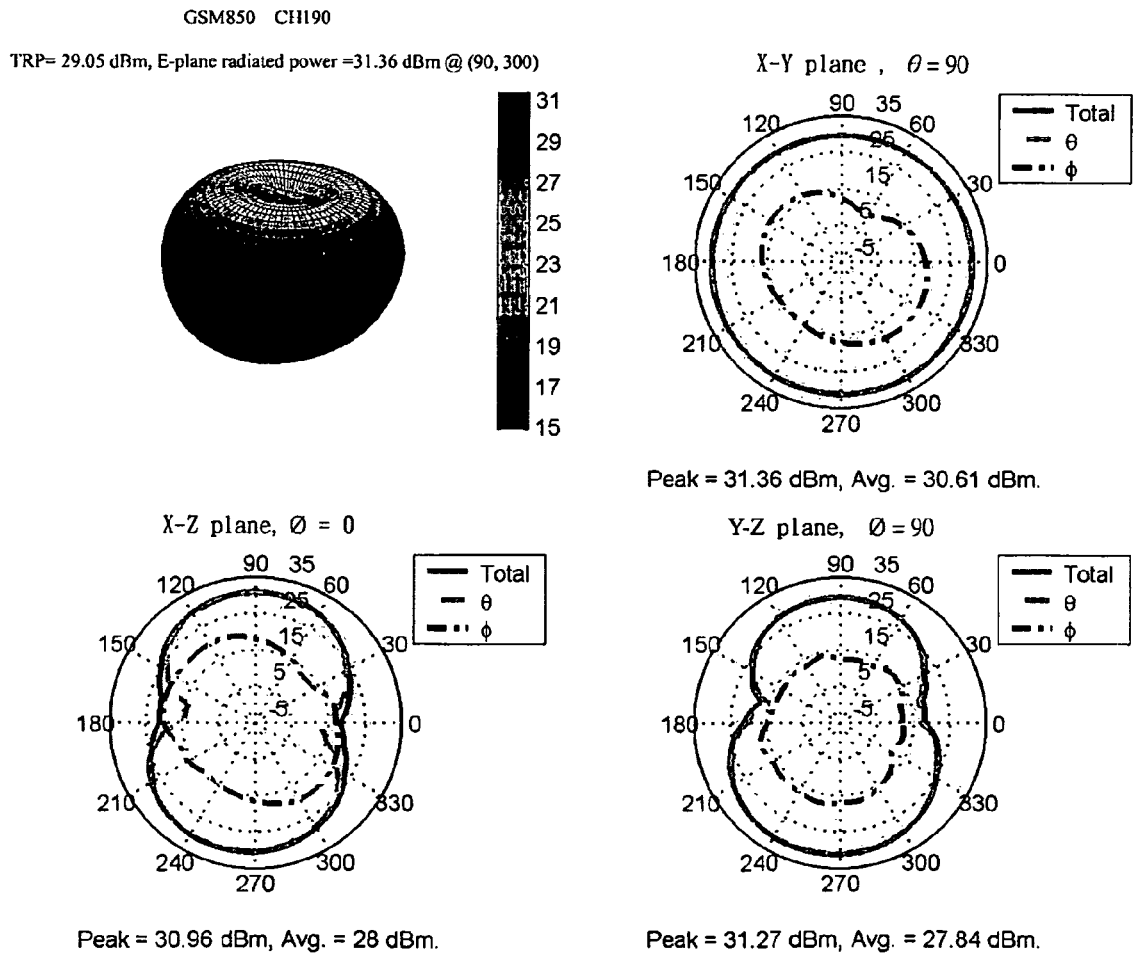
FIG. 5 shows plots of radiation patterns of the preferred embodiment respectively on the x-y, x-z, and y-z planes when operated in the GSM 850 band.
Figure 6:
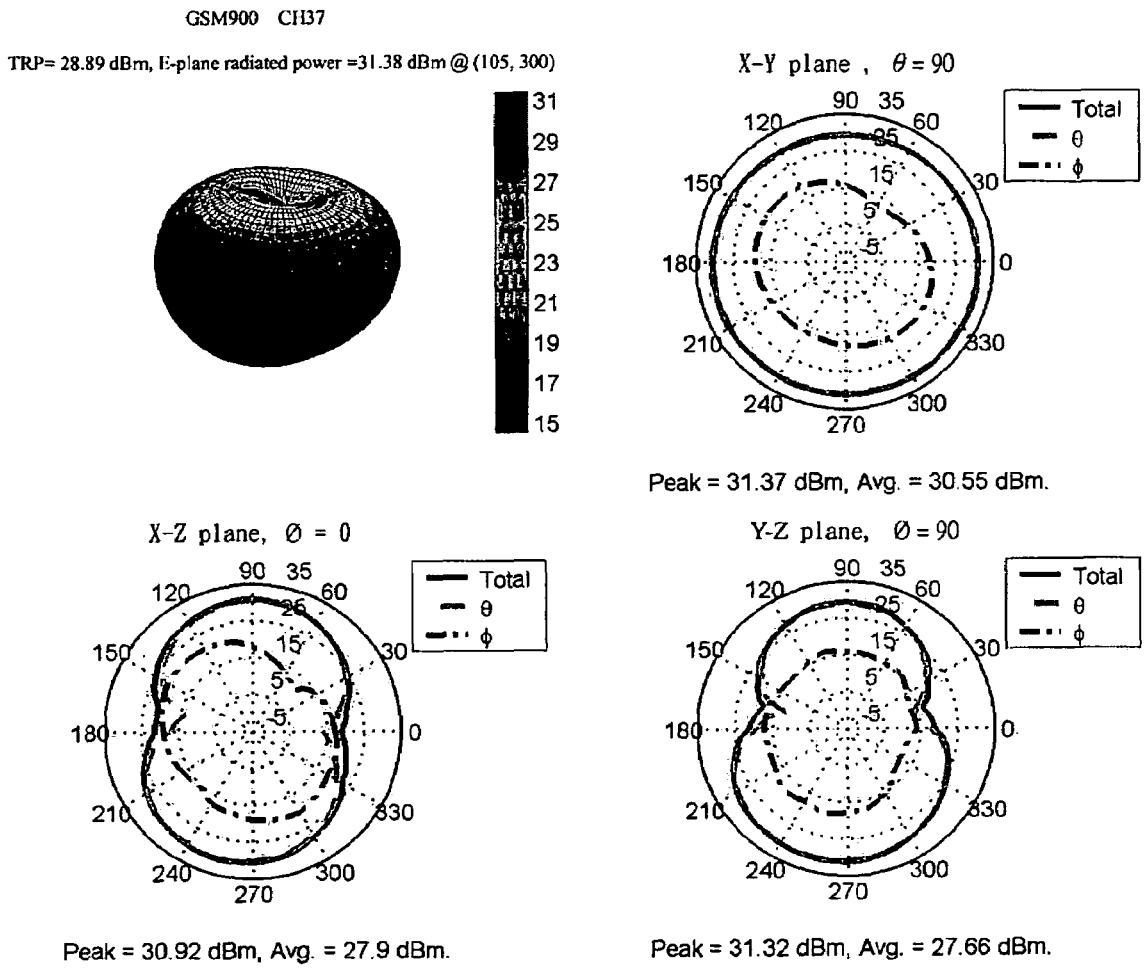
FIG. 6 shows plots of radiation patterns of the preferred embodiment respectively on the x-y, x-z, and y-z planes when operated in the GSM 900 band.
Figure 7:
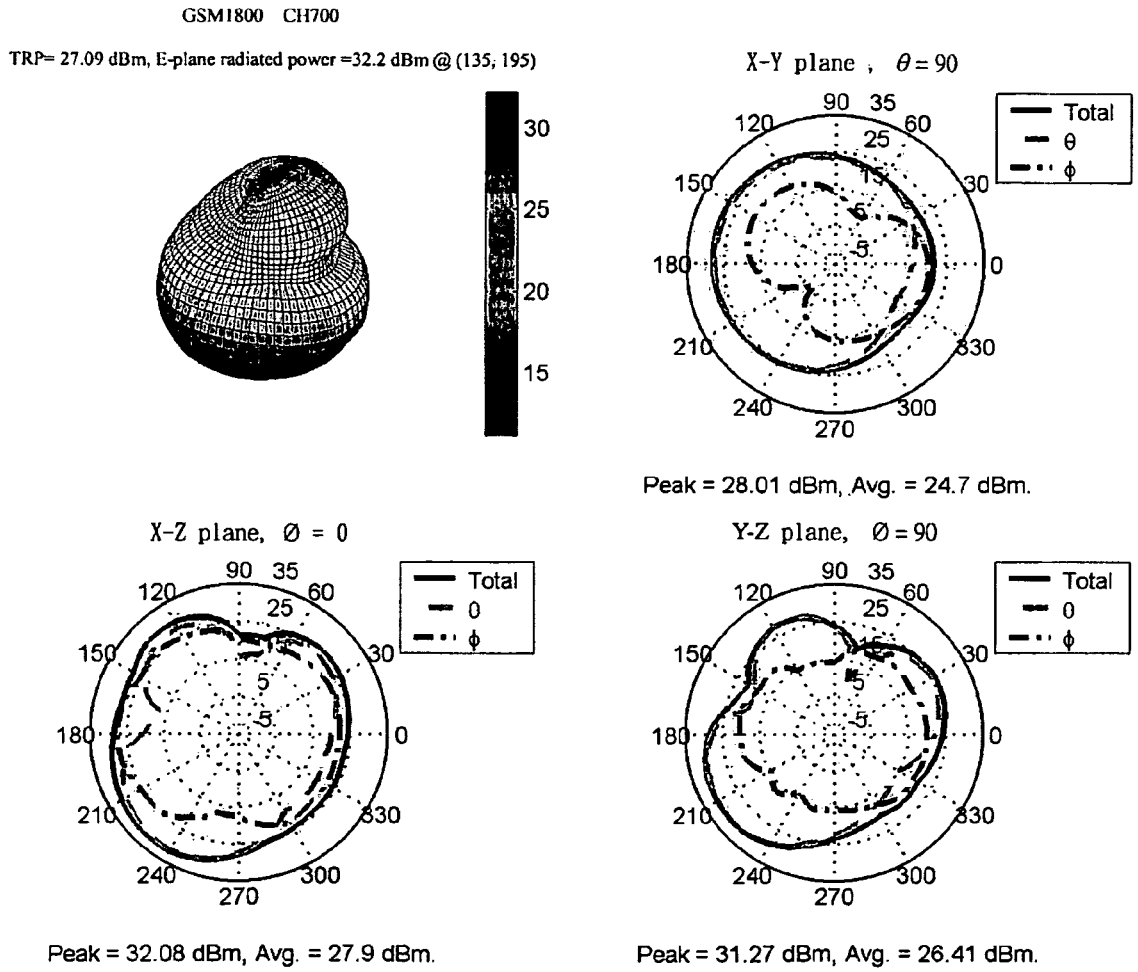
FIG. 7 shows plots of radiation patterns of the preferred embodiment respectively on the x-y, x-z, and y-z planes when operated in the GSM 1800 band.
Figure 8:
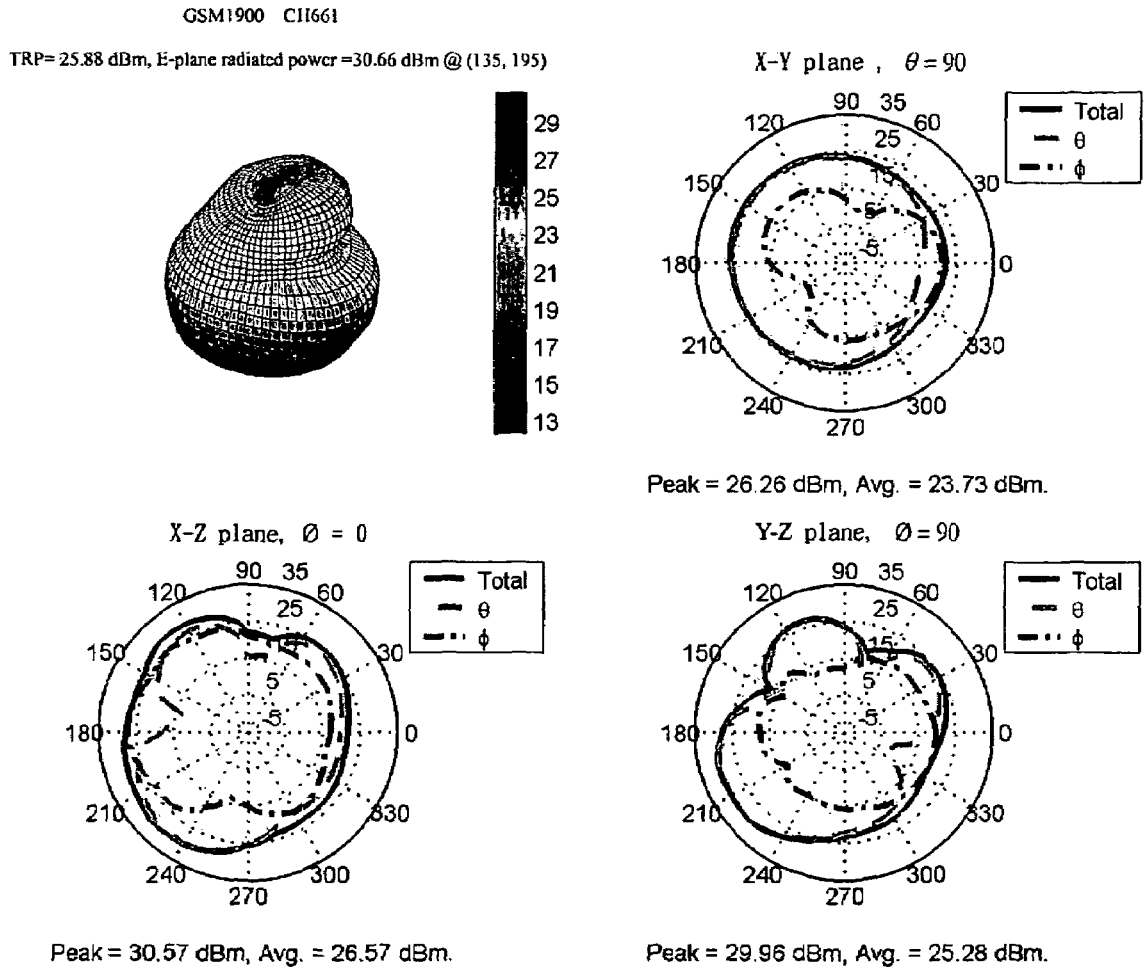
FIG. 8 shows plots of radiation patterns of the preferred embodiment respectively on the x-y, x-z, and y-z planes when operated in the GSM 1900 band.

Experimental results, as illustrated in FIG. 4, show that the antenna 2 of this invention, since the second grounding element 7 controls the degree at which an impedance is concentrated in the second frequency band, achieves a voltage standing wave ratio (VSWR) of less than 3.0 and an input impedance of 50 Ohms when operated in the second frequency band. Moreover, as shown in Table I below, the antenna 2 of this invention achieves total radiated powers (TRP) larger than 25 dBm when operated on three different channels of each of the GSM 850 band, i.e., 824 MHz to 894 MHz, the GSM 900 band, i.e., 880 MHz to 960 MHz, the GSM 1800 band, i.e., 1710 MHz to 1880 MHz, and the GSM 1900 band, i.e., 1850 MHz to 1990 MHz. Further, as illustrated in FIGS. 5, 6, 7, 8, the antenna 2 of this invention has substantially omnidirectional radiation patterns when operated in each of the GSM 850 band, the GSM 900 band, the GSM 1800 band, and the GSM 1900 band.

TABLE I

| Band | channel | TRP (dBm) | channel | TRP (dBm) | channel | TRP (dBm) |
|---|---|---|---|---|---|---|
| GSM 850 | Ch 128 | 28.4 | Ch 190 | 29.1 | Ch 251 | 29.4 |
| GSM 900 | Ch 975 | 29.1 | Ch 37 | 28.9 | Ch 124 | 28.8 |
| GSM 1800 | Ch 512 | 26.7 | Ch 700 | 27.1 | Ch 885 | 26.8 |
| GSM 1900 | Ch 512 | 25.9 | Ch 661 | 25.9 | Ch 810 | 25.8 |

It has thus been shown that the antenna 2 of this invention includes a base element 4, feeding and grounding points 411, 421, each of which is provided on a respective one of first and second end portions 41, 42 of the base element 4, first and second radiating elements 5, 6, each of which extends from the first end portion 41 of the base element 4, a first grounding element 8 connected to the grounding point 421, a feeding element 9 connected to the feeding point 411, and a second grounding element 7 connected to the feeding element 9. The construction as such permits the antenna 2 of this invention to operate in a first frequency band from 1710 MHz to 1990 MHz, which corresponds to the GSM 1800 band and the GSM 1900 band, and a second frequency band from 824 MHz to 960 MHz, which corresponds to the GSM 850 band and the GSM 900 band.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna, comprising:

a base element having opposite first and second end portions;

feeding and grounding points, each of which is provided on a respective one of said first and second end portions of said base element;

a first radiating element operable in a first frequency band, and extending from said first end portion of said base element; and a second radiating element operable in a second frequency band lower than the first frequency band, extending from said first end portion of said base element, and formed with a slot, said slot having a predetermined size that corresponds to the second frequency band.

2. The antenna as claimed in claim 1, wherein said first and second end portions of said base element are opposite to each other in a first direction, said base element further having first and second sides that are opposite to each other in a second direction substantially transverse to the first direction, each of said first and second radiating elements being disposed at a respective one of said first and second sides of said base element.

3. The antenna as claimed in claim 2, wherein said slot in said second radiating element is an elongated slot and extends in the first direction.

4. The antenna as claimed in claim 2, wherein said first radiating element has a first end portion that extends from said first end portion of said base element, and a second end portion that is opposite to said first end portion thereof in the second direction, and is tapered toward said second end portion thereof.

5. The antenna as claimed in claim 4, further comprising a protrusion protruding from said second end portion of said first radiating element.

6. The antenna as claimed in claim 5, wherein said protrusion is an elongated protrusion and extends in the first direction.

7. The antenna as claimed in claim 1, further comprising:

a feeding element connected to said feeding point;

a first grounding element connected to said grounding point; and a second grounding element connected to said feeding element.

8. The antenna as claimed in claim 1, wherein said base element is generally rectangular in shape.

9. The antenna as claimed in claim 1, wherein the first frequency band covers frequencies between 1710 MHz and 1990 MHz.

10. The antenna as claimed in claim 1, wherein the second frequency band covers frequencies between 824 MHz and 960 MHz.

* * * * *

UNITED STATES PATENT AND TRADEMARK OFFICE

CERTIFICATE OF CORRECTION

PATENT NO. : 7,701,402 B2
APPLICATION NO. : 12/188321
DATED : April 20, 2010
INVENTOR(S) : Tiao-Hsing Tsai et al.

It is certified that error appears in the above-identified patent and that said Letters Patent is hereby corrected as shown below:

On title page, item 74 Attorney, Agent, or Firm, replace "Sunstein Kahn Murphy & Timbers LLP" with "Sunstein Kann Murphy & Timbers LLP."

Signed and Sealed this

First Day of June, 2010

David J. Kappos

David J. Kappos
*Director of the United States Patent and Trademark Office*